US011130015B2

(12) United States Patent
Wang

(10) Patent No.: US 11,130,015 B2
(45) Date of Patent: Sep. 28, 2021

(54) FLYWHEEL EXERCISER HAVING A HYBRID RESISTANCE SYSTEM

(71) Applicant: Ya-Chi Chen, New Taipei (TW)

(72) Inventor: Chin-Liu Wang, Taichung (TW)

(73) Assignee: Ya-Chi Chen, New Taipei (TW)

( * ) Notice: Subject to any disclaimer, the term of this patent is extended or adjusted under 35 U.S.C. 154(b) by 0 days.

(21) Appl. No.: 16/808,160

(22) Filed: Mar. 3, 2020

(65) Prior Publication Data

US 2020/0306580 A1 Oct. 1, 2020

(30) Foreign Application Priority Data

Mar. 27, 2019 (TW) ..... 108203706

(51) Int. Cl.

| | |
|---|---|
| ***A63B 21/22*** | (2006.01) |
| ***A63B 21/005*** | (2006.01) |
| ***A63B 21/008*** | (2006.01) |
| ***A63B 22/06*** | (2006.01) |

(52) U.S. Cl.

CPC ..... *A63B 21/225* (2013.01); *A63B 21/0051* (2013.01); *A63B 21/0088* (2013.01); *A63B 22/0605* (2013.01)

(58) Field of Classification Search

CPC ..... A63B 21/00058; A63B 21/00192; A63B 21/005; A63B 21/0051; A63B 21/0052; A63B 21/0053; A63B 21/0056; A63B 21/0057; A63B 21/22; A63B 21/225

See application file for complete search history.

(56) References Cited

U.S. PATENT DOCUMENTS

| | | | | |
|---|---|---|---|---|
| 2005/0003934 | A1* | 1/2005 | Wu | A63B 21/0051 482/64 |
| 2016/0298654 | A1* | 10/2016 | Wang | F04D 17/16 |
| 2018/0140896 | A1* | 5/2018 | Chen | A63B 22/02 |
| 2019/0083839 | A1* | 3/2019 | Wang | A63B 22/06 |
| 2019/0217142 | A1* | 7/2019 | Hsu | A63B 21/0088 |
| 2019/0255376 | A1* | 8/2019 | Wu | A63B 21/00076 |
| 2020/0306580 | A1* | 10/2020 | Wang | A63B 21/0088 |

* cited by examiner

*Primary Examiner* — Garrett K Atkinson
*Assistant Examiner* — Zachary T Moore
(74) *Attorney, Agent, or Firm* — Wang Law Firm, Inc.

(57) ABSTRACT

A flywheel exerciser having a hybrid resistance system includes: a body having a flywheel unit; a wind resistance system disposed on the flywheel unit; and a magnetic resistance system disposed on the flywheel unit. The wind resistance system is a conventional wind resistance which provides segmental adjustment, the present invention is additionally provided with a magnetic resistance system. When the resistance generated by the wind resistance system is insufficient or excessive, the resistance can be further finely increased or decreased by adjusting the magnetic resistance system to provide the resistance that best meets the user's needs.

5 Claims, 6 Drawing Sheets

FLYWHEEL EXERCISER HAVING A HYBRID RESISTANCE SYSTEM

BACKGROUND

Field of the Invention

The present invention relates to a fitness equipment, in particular to a flywheel exerciser having a hybrid resistance system.

Related Prior Art

People today cannot go outdoors for exercise due to busy work or bad weather, which has created the popularity of indoor fitness equipment. The exercise bike is a kind of exercise equipment that simulates the exercise of bikes. It can achieve the purpose of training muscles and strengthening heart and lung function by stepping on the exercise mechanism of the exercise bike.

In recent years, due to lack of exercise, people's health and spirit have been seriously affected. Due to the limited number of outdoor sports venues and the weather changes, there are many inconveniences in carrying out exercise activities. Indoor sports are less restricted by the weather, and their privacy is better than that of outdoor sports, so it is popular with many people.

Indoor sports are mainly achieved by using various fitness equipments, including exercise bikes, treadmills, elliptical machines, ski machines, etc. The exercise bikes can be mainly divided into vertical type and horizontal type (also called lying type or lazy type). The existing exercise bike essentially comprises a frame with support legs at both ends, a seat disposed in the middle of the frame, a handrail disposed in the front of the frame, a damping unit disposed below the handrail, and a pedal unit drivingly connected to the damping unit. The user can sit on the seat, pedaling on the pedal unit with feet, and the drivingly connected damping unit produces appropriate resistance, so as to achieve the purpose of exercising or rehabilitation of the foot muscle endurance.

However, the structure of the above-mentioned exercise bike still has design shortcomings. Since the damping unit of the above-mentioned exercise bikes are mostly wind resistance and have fan blades assembled on the wheels of the exercise bikes, and by adjusting the angle of the fan blades to increase or decrease the wind resistance, so that the resistance of the damping unit can be adjusted. The adjustment of the wind resistance is a kind of segmental change. Generally, there are seven segmental changes from the first to the seventh. For the simpler example, when the resistance is adjusted to the first stage of resistance, the user will feel the resistance of 10 Newtons. When the resistance is adjusted to the second stage of resistance, the user will feel the resistance of 20 Newtons, and so on. When the user adjusts one stage for each adjustment, the resistance value will increase by about 10 Newtons. The 10 Newton resistance or 20 Newton resistance defined in the above example is only for easy explanation, and is not exactly the same as the actual operation. In actual operation, different exercise bikes in different stages of adjustment provide resistance values. This type of resistance adjustment often causes the user to feel the resistance is too low when adjusting the resistance to a certain stage, but feel the resistance is too high when the resistance is increased by a stage.

The present invention has invented a flywheel exerciser with hybrid resistance system to mitigate and/or obviate the afore-described disadvantages.

SUMMARY

One objective of the present invention is to solve the abovementioned disadvantage that the segmental adjustment of resistance cannot provide appropriate resistance that can meet the user's requirement.

To achieve the above objective, a flywheel exerciser having a hybrid resistance system in accordance with the present invention comprises:

a body having a flywheel unit;

a wind resistance system disposed on the flywheel unit; and a magnetic resistance system disposed on the flywheel unit.

Preferably, the magnetic resistance system has a magnet attracting member, an adjustment member, a magnetic member, and a pivot member, the magnet attracting member is fixed to the flywheel unit, the adjustment member is fixed to the flywheel unit and has a first hole, the magnetic member has one end pivotally connected to the flywheel unit and is provided with a second hole, the pivot member has one end pivotally connected to the flywheel unit and includes a first portion and a second portion, a first bolt is inserted through the first portion and disposed in the first hole, and a second bolt is inserted through the second portion and disposed in the second hole.

Preferably, the magnetic member is provided with a plurality of magnetic blocks.

Preferably, the pivot member is T-shaped and has three ends, one of which is pivotally connected to the flywheel unit, another of which is the first portion, and the last one of which is the second portion.

Preferably, the flywheel unit has a through hole which is arc-shaped, and the first bolt is inserted through the first hole and the through hole.

Preferably, the flywheel unit is provided with a pedaling unit, and the wind resistance system is drivingly connected to the pedaling unit.

Preferably, the body has a bracket unit, the flywheel unit is fixed on the bracket unit, and the bracket unit is further provided with a pedaling unit for the user to pedal.

Preferably, the body has a bracket unit, the flywheel unit is fixed on the bracket unit, the flywheel unit has a first outer casing and a second outer casing, the first outer casing is fixed on the bracket unit, the second outer casing is detachably assembled to the first outer casing and provided with a plurality of ventilation holes, and the first outer casing and the second outer casing are combined to form a space for accommodating the wind resistance system and the magnetic resistance system.

The wind resistance system is a conventional wind resistance which provides segmental adjustment, the present invention is additionally provided with a magnetic resistance system. When the resistance generated by the wind resistance system is insufficient or excessive, the resistance can be further finely increased or decreased by adjusting the magnetic resistance system to provide the resistance that best meets the user's needs.

More preferably, after the wind resistance system is adjusted to the maximum level, the user can further adjust the magnetic resistance system to the maximum level, so that the total resistance produced by the present invention is greater than the prior art having only the wind resistance system.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

Figure 1:
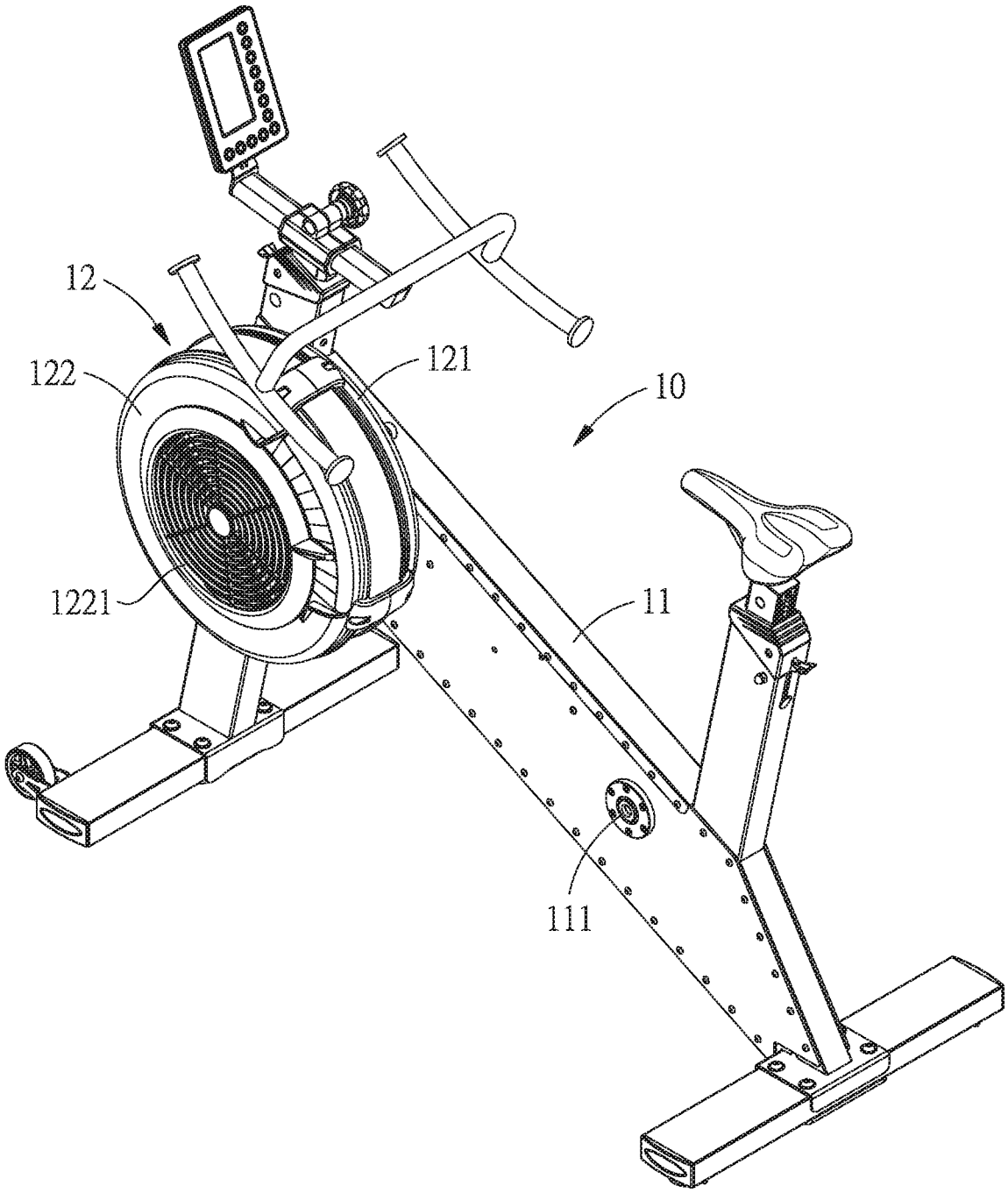
FIG. 1 is a perspective view of the present invention in a preferred embodiment.
Figure 2:
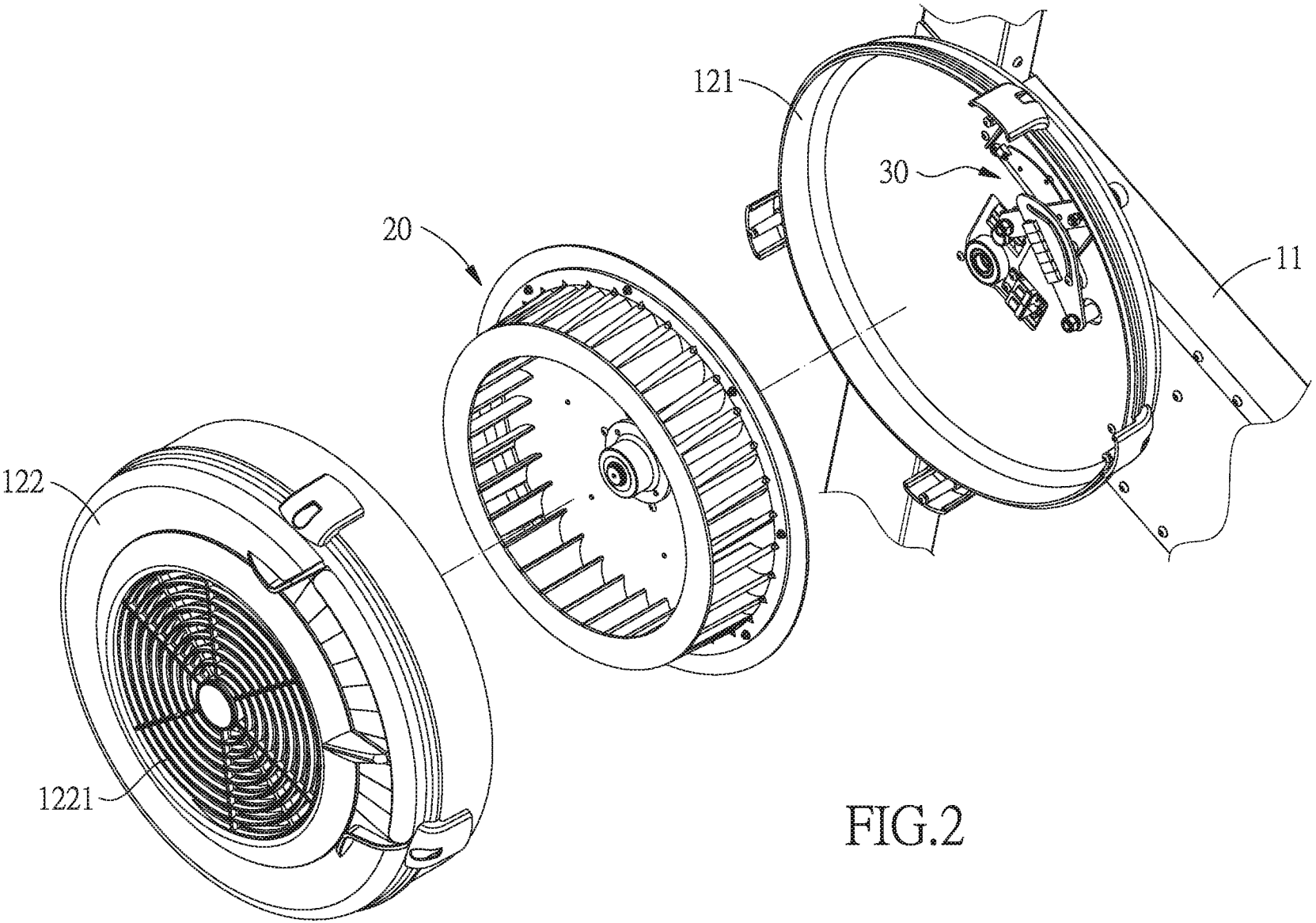
FIG. 2 is an exploded view of the flywheel unit, the wind resistance system, and the magnetic resistance system of the present invention in accordance with a preferred embodiment.
Figure 3:
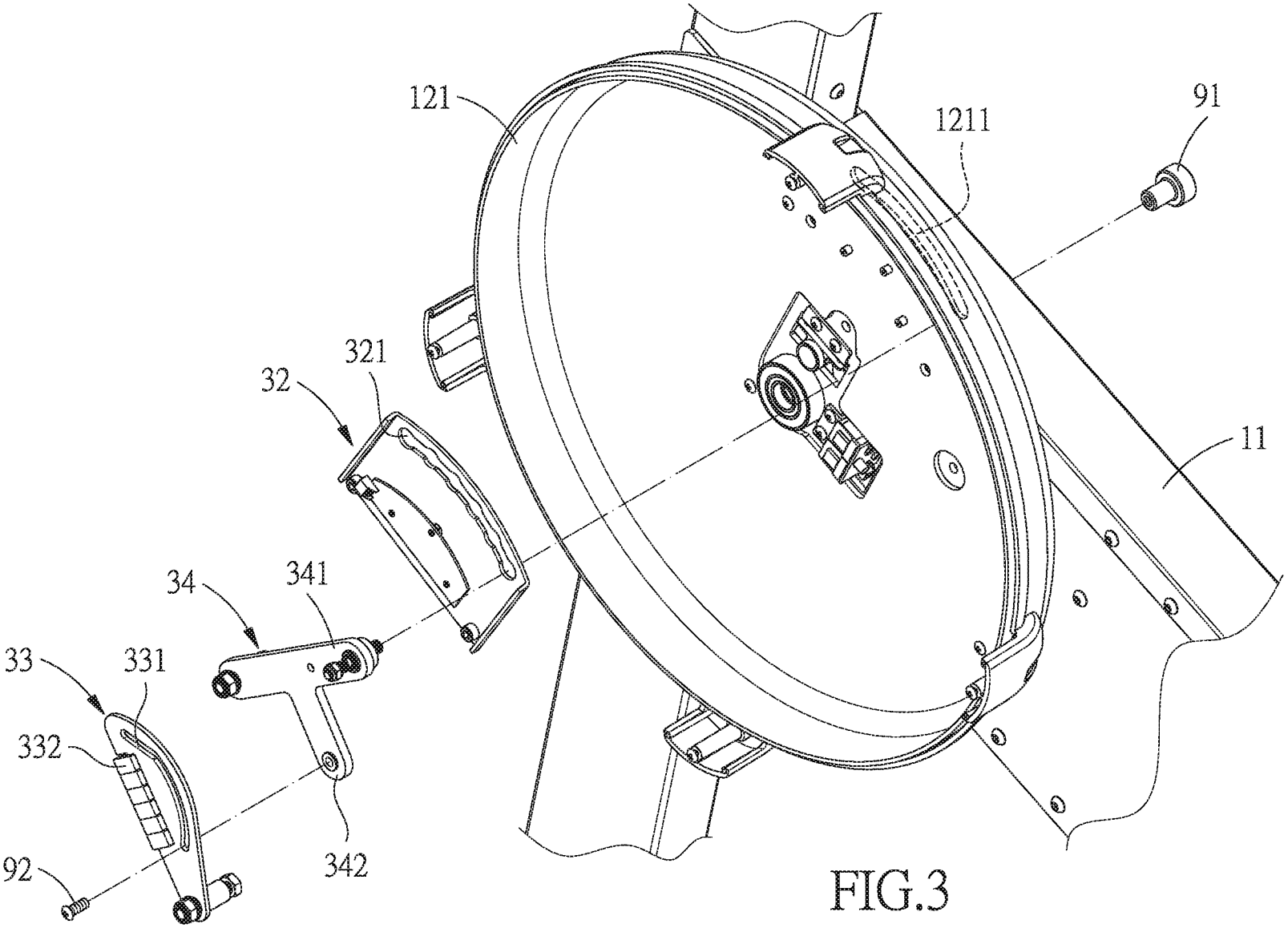
FIG. 3 is an exploded view of the magnetic resistance system of the present invention in a preferred embodiment.

The present invention will be clearer from the following description when viewed together with the accompanying drawings, which show, for purpose of illustrations only, the preferred embodiment in accordance with the present invention.

Referring to FIGS. 1-4, a flywheel exerciser having a hybrid resistance system in accordance with the present invention is provided, and comprises: a body 10, a wind resistance system 20, and a magnetic resistance system 30.

The body 10 has a bracket unit 11 and a flywheel unit 12 fixed on the bracket unit 11. The bracket unit 11 is further provided with a pedaling unit 111 for the user to pedal. In this embodiment, the pedaling unit 111 is a flywheel pedal. The wind resistance system 20 is disposed on the flywheel unit 12, and drivingly connected to the pedaling unit 111. The wind resistance system 20 can be rotated by the pedaling unit 111. Since the wind resistance system 20 provides a first resistance, the user feels resistance when pedaling the pedaling unit 111.

The magnetic resistance system 30 is disposed on the flywheel unit 12, and provides a second resistance. With the wind resistance system 20 and the magnetic resistance system 30, the user feels the combined resistance of the first resistance and the second resistance when pedaling the pedaling unit 111.

In this embodiment, the flywheel unit 12 has a first outer casing 121 and a second outer casing 122. The first outer casing 121 is fixed on the bracket unit 11 and provided with a through hole 1211 which is arc-shaped, and the second outer casing 122 is detachably assembled to the first outer casing 121 and provided with a plurality of ventilation holes 1221. The first outer casing 121 and the second outer casing 122 are combined to form a space for accommodating the wind resistance system 20 and the magnetic resistance system 30.

In this embodiment, the magnetic resistance system 30 has a magnet attracting member 31, an adjustment member 32, a magnetic member 33, and a pivot member 34. The magnet attracting member 31 is fixed to the flywheel unit 12. The adjustment member 32 is fixed to the flywheel unit 12 and has a first hole 321. The magnetic member 33 has one end pivotally connected to the flywheel unit 12 and is provided with a second hole 331. The pivot member 34 has one end pivotally connected to the flywheel unit 12, and includes a first portion 341 and a second portion 342. A first bolt 91 is inserted through the first portion 341 and disposed in the first hole 321, and a second bolt 92 is inserted through the second portion 342 and disposed in the second hole 331.

The pivot member 34 is T-shaped and has three ends, one of which is pivotally connected to the first outer casing 121 of the flywheel unit 12, another of which is the first portion 341, and the last one of which is the second portion 342. Preferably, the magnetic member 33 is provided with a plurality of magnetic blocks 332 which are disposed on the first outer casing 121 in an annular manner.

In this embodiment, the first bolt 91 is inserted through the first hole 321 and the through hole 1211 and extended out of the space, so that the user can adjust the first bolt 91 to change the distance between the magnet attracting member 31 and the magnetic member 33, thereby adjusting the magnetic resistance generated between the magnet attracting member 31 and the magnetic member 33.

The above is the structural configuration and the connection relationship of the preferred embodiment of the present invention, and the usage of the invention explained as follows:

When the user wants to adjust the resistance, the wind resistance system 20 can be adjusted first. Since the adjustment method of the wind resistance system 20 is the same as the conventional method, it will not be described here. After adjusting the resistance of the wind resistance system 20, the user then adjusts the magnetic resistance system 30.

Figure 4:
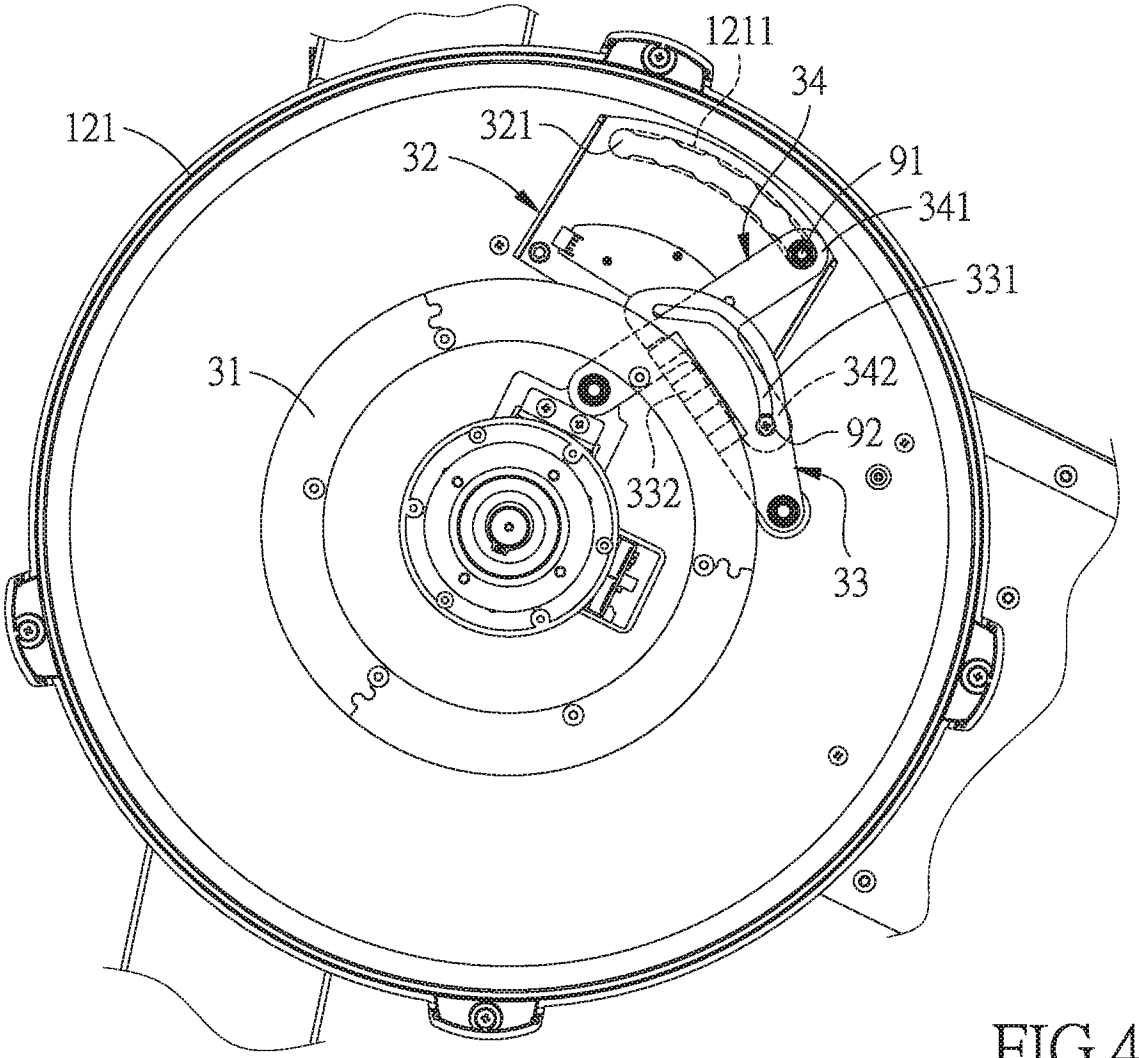
FIG. 4 is an operational view of the magnetic resistance system in a first state in a preferred embodiment of the present invention.
Figure 5:
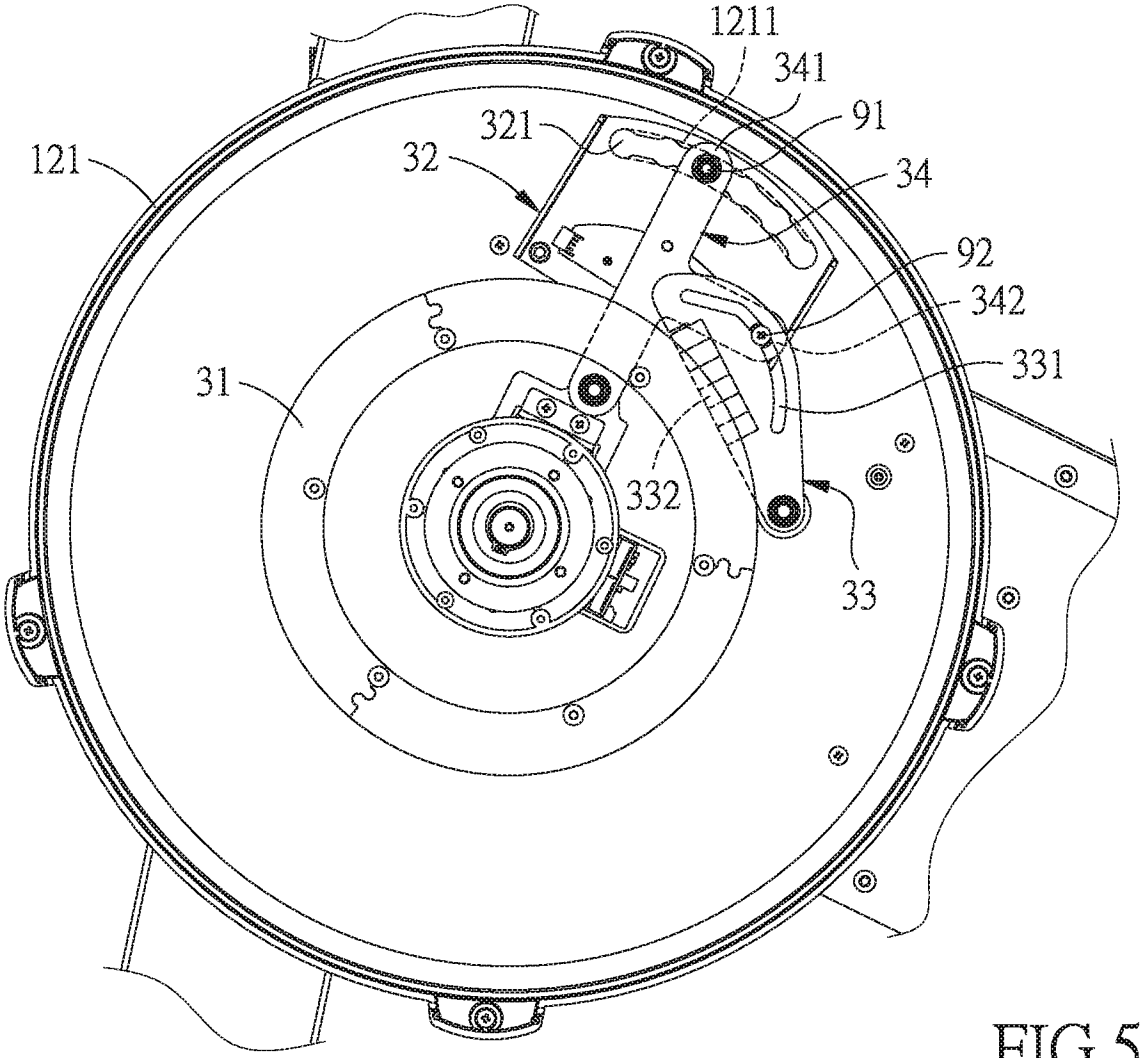
FIG. 5 is an operational view of the magnetic resistance system in a second state in a preferred embodiment of the present invention.
Figure 6:
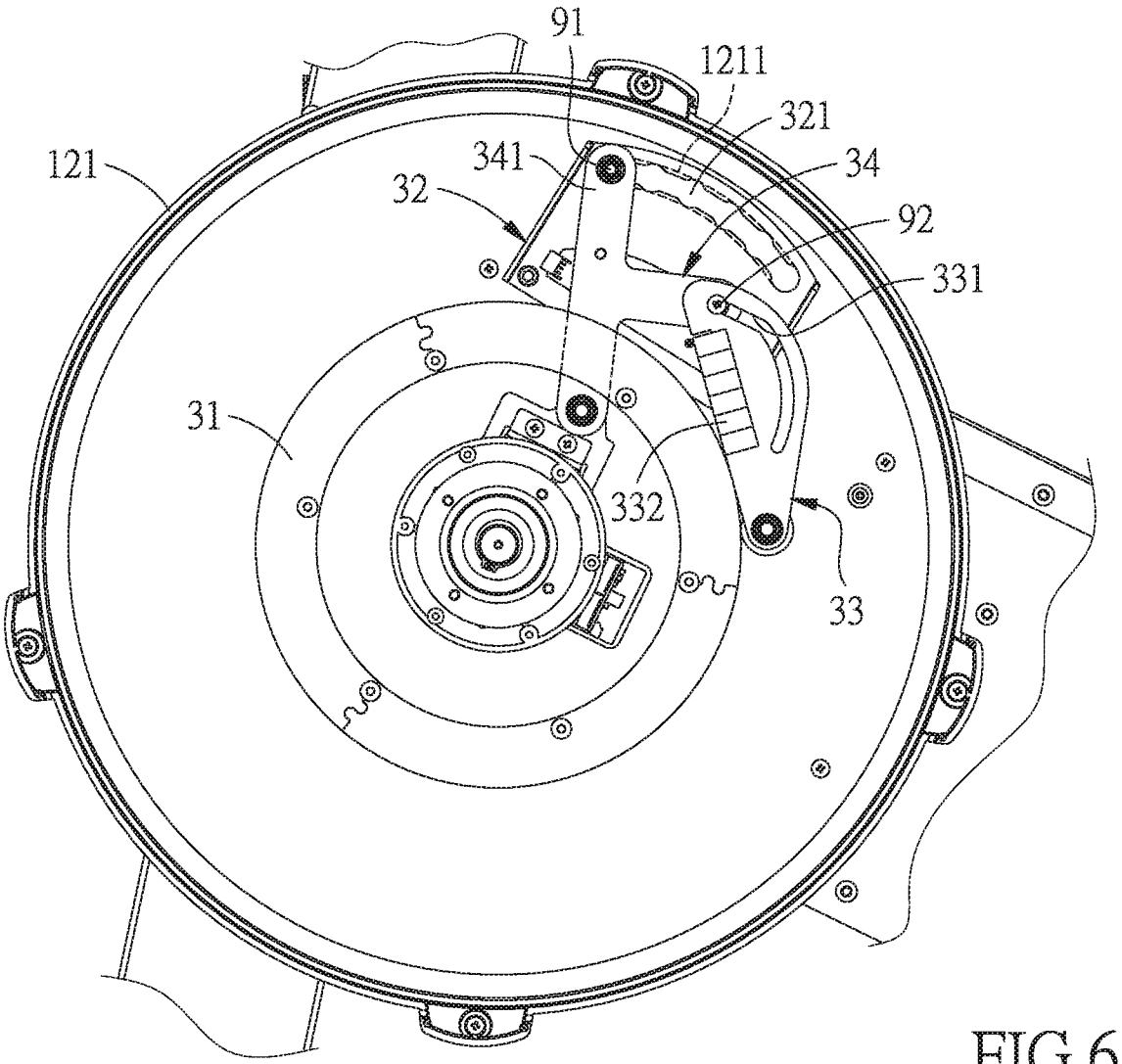
FIG. 6 is an operational view of the magnetic resistance system in a third state in a preferred embodiment of the present invention.

Referring to FIGS. 4-6, when the user adjusts the magnetic resistance system 30, the first bolt 91 can be adjusted first. When the first bolt 91 changes position in the first hole 321, the second bolt 92 also changes position in the second hole 331, which changes the distance between the magnetic member 33 and the magnet attracting member 31, thereby adjusting the magnetic resistance generated by the magnetic resistance system 30. The closer the magnetic member 33 is to the magnet attracting member 31, the greater the resistance will be generated, and the farther the magnetic member 33 is from the magnet attracting member 31, the smaller the resistance will be generated.

The wind resistance system 20 is a conventional wind resistance which provides segmental adjustment, the present invention is additionally provided with a magnetic resistance system 30. When the resistance generated by the wind resistance system 20 is insufficient or excessive, the resistance can be further finely increased or decreased by adjusting the magnetic resistance system 30 to provide the resistance that best meets the user's needs.

More preferably, after the wind resistance system 20 is adjusted to the maximum level, the user can further adjust the magnetic resistance system 30 to the maximum level, so that the total resistance produced by the present invention is greater than the prior art having only the wind resistance system 20.

While we have shown and described various embodiments in accordance with the present invention, it is clear to those skilled in the art that further embodiments may be made without departing from the scope of the present invention.

What is claimed is:

1. A flywheel exerciser having a hybrid resistance system, comprising:

a body having a flywheel unit and a bracket unit, wherein the flywheel unit is fixed on the bracket unit, and the bracket unit is further provided with a pedaling unit for a user to pedal;

a wind resistance system disposed on the flywheel unit, wherein the wind resistance system is drivingly connected to the pedaling unit; and a magnetic resistance system disposed on the flywheel unit, wherein the magnetic resistance system has a magnet attracting member, an adjustment member, a magnetic member, and a pivot member, the magnet attracting member is fixed to the flywheel unit, the adjustment member is fixed to the flywheel unit and has a first hole, the magnetic member has one end pivotally connected to the flywheel unit and is provided with a second hole, the pivot member has one end pivotally connected to the flywheel unit and includes a first portion and a second portion, a first bolt is inserted through the first portion and disposed in the first hole, and a second bolt is inserted through the second portion and disposed in the second hole, when the first bolt changes position in the first hole, the second bolt also changes position in the second hole, which causes a distance between the magnetic member and the magnet attracting member to be changed, thus adjusting a magnetic resistance generated by the magnetic resistance system.

2. The flywheel exerciser having the hybrid resistance system as claimed in claim 1, wherein the magnetic member is provided with a plurality of magnetic blocks.

3. The flywheel exerciser having the hybrid resistance system as claimed in claim 1, wherein the pivot member is T-shaped and has three ends, one of which is pivotally connected to the flywheel unit, another of which is the first portion, and the last one of which is the second portion.

4. The flywheel exerciser having the hybrid resistance system as claimed in claim 1, wherein the flywheel unit has a through hole which is arc-shaped, and the first bolt is inserted through the first hole and the through hole.

5. The flywheel exerciser having the hybrid resistance system as claimed in claim 1, wherein the body has a bracket unit, the flywheel unit is fixed on the bracket unit, the flywheel unit has a first outer casing and a second outer casing, the first outer casing is fixed on the bracket unit, the second outer casing is detachably assembled to the first outer casing and provided with a plurality of ventilation holes, and the first outer casing and the second outer casing are combined to form a space for accommodating the wind resistance system and the magnetic resistance system.

* * * * *